US010092816B2

(12) United States Patent
Ritter

(10) Patent No.: US 10,092,816 B2
(45) **Date of Patent: *Oct. 9, 2018**

(54) SPLITBOARD BOOT BINDING SYSTEM WITH ADJUSTABLE HIGHBACK

(71) Applicant: SPARK R&D IP HOLDINGS, LLC, Bozeman, MT (US)

(72) Inventor: William J Ritter, Bozeman, MT (US)

(73) Assignee: SPARK R&D IP HOLDINGS, LLC, Bozeman, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/650,887

(22) Filed: Jul. 15, 2017

(65) Prior Publication Data

US 2017/0368446 A1 Dec. 28, 2017

Related U.S. Application Data

(63) Continuation of application No. 15/004,085, filed on Jan. 22, 2016, now Pat. No. 9,833,686.

(60) Provisional application No. 62/109,149, filed on Jan. 29, 2015.

(51) Int. Cl.

| | |
|---|---|
| ***A63C 10/00*** | (2012.01) |
| ***A63C 10/20*** | (2012.01) |
| ***A63C 10/24*** | (2012.01) |
| ***A63C 5/02*** | (2006.01) |
| ***A63C 9/00*** | (2012.01) |
| ***A63C 9/02*** | (2012.01) |
| ***A63C 10/04*** | (2012.01) |
| *A63C 10/06* | (2012.01) |

(52) U.S. Cl.

CPC ..... *A63C 10/20* (2013.01); *A63C 5/02* (2013.01); *A63C 9/00* (2013.01); *A63C 9/02* (2013.01); *A63C 10/04* (2013.01); *A63C 10/24* (2013.01); *A63C 10/06* (2013.01)

(58) Field of Classification Search

CPC ..... A63C 10/24; A63C 10/00; A63C 9/00; A63C 10/20; A63C 5/02

See application file for complete search history.

(56) References Cited

U.S. PATENT DOCUMENTS

| | | | | | |
|---|---|---|---|---|---|
| 3,619,914 | A | * | 11/1971 | Hanson et al. | A43B 5/0456 36/118.4 |
| 4,367,885 | A | * | 1/1983 | Ramer | A63C 9/00 280/614 |
| 4,456,769 | A | * | 6/1984 | Bonse | C07C 257/22 564/226 |
| 4,991,319 | A | * | 2/1991 | Perner | A43B 5/0456 36/118.3 |
| 5,276,982 | A | * | 1/1994 | Wittmann | A43B 5/0456 36/118.4 |
| 5,446,976 | A | * | 9/1995 | Donnadieu | A43B 5/0411 36/117.2 |

(Continued)

*Primary Examiner* — Hau V Phan

(74) *Attorney, Agent, or Firm* — Stone Creek Services LLC; Alan M Flum

(57) ABSTRACT

An improved highback adjustment system for a splitboard boot binding. A captive strut is mounted on the spine of the highback, the strut having a forward lean adjustor block such that rotation or sliding of the block lengthens or shortens the strut. The combination provides a broadly adjustable range of forward lean bias in small increments and the block is readily disengaged and stowed on the highback when not needed. Advantageously, the mechanism that can be operated and adjusted without tools, even with gloved hands, a significant benefit in winter conditions, and does not jam with snow. Methods of use of the improved forward lean adjustor and highback are also disclosed.

17 Claims, 12 Drawing Sheets

(56) References Cited

U.S. PATENT DOCUMENTS

| | | | | | |
|---|---|---|---|---|---|
| 5,727,797 | A * | 3/1998 | Bowles | A63C 10/24 | 280/14.21 |
| 5,784,810 | A * | 7/1998 | Bonaventure | A43B 5/0456 | 36/118.2 |
| 5,909,885 | A * | 6/1999 | Borel | A43B 5/0456 | 280/11.19 |
| 5,997,027 | A * | 12/1999 | Jungkind | A63C 10/045 | 280/14.21 |
| 6,023,974 | A * | 2/2000 | Hara | G01C 19/56 | 73/504.15 |
| 6,231,057 | B1 * | 5/2001 | Reuss | A43B 5/0401 | 280/14.21 |
| 6,283,492 | B1 * | 9/2001 | Hale | A63C 10/24 | 280/11.36 |
| 6,533,295 | B2 * | 3/2003 | Gonthier | A63C 10/24 | 280/14.22 |
| 7,029,023 | B2 * | 4/2006 | Fougere | A63C 10/04 | 280/11.36 |
| 7,134,928 | B1 * | 11/2006 | Cannon | A63C 10/04 | 441/70 |
| 8,573,631 | B2 * | 11/2013 | Rancon | A63C 10/24 | 280/14.22 |
| 8,684,394 | B2 * | 4/2014 | Smith | A63C 10/24 | 280/14.22 |
| 9,833,686 | B2 * | 12/2017 | Ritter | A63C 10/24 | |
| 2003/0075885 | A1 * | 4/2003 | Laughlin | A63C 10/10 | 280/11.36 |

* cited by examiner

SPLITBOARD BOOT BINDING SYSTEM WITH ADJUSTABLE HIGHBACK

CROSS REFERENCE TO RELATED APPLICATIONS

This application is related to and claims the benefit of priority under 35 U.S.C. § 119(e) from U.S. Provisional Patent No. 62/109149 filed Jan. 29, 2015 which is herein incorporated in full by reference for all purposes. Related applications include U.S. Pat. No. 9,452,344, entitled "PUCK SYSTEM", filed 28 Dec. 2015; said patent documents being incorporated herein in entirety for all purposes by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

GOVERNMENT SUPPORT

Not Applicable.

FIELD OF THE INVENTION

An improved highback for snow sports, the highback having an adjustable strut for selecting forward lean angle. Combinations with boot binding interfaces are also disclosed.

BACKGROUND

Splitboarding is an exciting winter sport and is growing internationally. Derived from snowboarding, the splitboarder advantageously can disassemble the splitboard and either can carry the two ski halves or can ski up a slope to a higher elevation; then reassemble the board halves and ride downhill in "descent mode" just as on a one-piece snowboard. Thus the splitboarder is not dependent on ski lifts and can explore virgin backcountry runs with no limitations. Splitboards thus have the flexibility of interconverting between a ski or touring mode and a snowboard descent mode. To achieve the dual function, two boot binding interfaces are provided: a "ski tour interface" is used when skiing, and a "ride mode interface" is used when riding the board in descent mode. Advantageously, the rider's legs are rigidly anchored together on the board in descent mode, reducing the risk of knee injuries common in downhill skiing. Highbacks mounted at the heel roughly even out how sharply a rider can turn on the toeside of the board and provide support for making heelside turns. Without a highback, especially on firm snow, heelside turns are quite difficult.

Splitboards were first made by Ueli Bettenmann, as described European Pat. Doc. Nos. CH681509, CH684825, German Gebrauchsmuster DE9108618, and EP0362782B1, first under the tradename Snowhow, and later in conjunction with Nitro (Seattle, Wash.). Another early entrant commercially was Voile (Salt Lake City, Utah). The popular "Split Decision" introduced a binding system described in U.S. Pat. No. 5,984,324 to Wariakois. The patent describes a "slider track" with insertable toe pivot pin for each foot, the slider track joining pairs of "slider blocks" mounted crosswise on each ski member; the toe pivot pin also serving as a pivot axle for free heel ski touring. This innovation resulted in substantial growth of interest in splitboarding in the United States and has had a worldwide impact on the sport.

Ritter, in U.S. Pat. Nos. 7,823,905, 8,226,109 and in 9,022,412, discloses a stiffer, lower and lighter binding for spanning slider blocks mounted crosswise on the splitboard. These bindings are being commercialized by Spark R&D of Bozeman MT and have developed an international following.

Splitboard binding systems for soft boots typically include an upright member, called a "highback", that seats behind the heel and supports a rider's calf. The highback improves coupling efficiency, allowing the rider to better control the board through leg movement. For example, leaning back against the highback places the board on its heel edge for a heelside turn, while balancing the rider. Momentum does the rest.

Conventional highbacks generally include an upright support member formed with a pair of lateral pivot ears for mounting the highback to a boot binding apparatus, which includes toe and ankle straps. A splitboard rider's legs are generally held by the highback at a forward angle relative to the board. This stance provides better balance, control and ensures the rider's knees are slightly bent for better shock absorption, particularly in bumpy or variable snow conditions. To hold the rider's leg in such a stance, the highback is typically inclined relative to the board in a position referred to as "forward lean". A desired amount of forward lean is set by pivoting the highback in the toe direction on the mounting axis and locking its position so that it engages a portion of the boot binding, typically a "heel cup", to provide leverage against the highback. Increasing the forward lean increases the response of the board on a heelside turn, but at the same time constrains the rider's legs to a degree and can inhibit necessary movements used to negotiate varying terrain. Thus there is a balance to be struck between support and mobility. Each rider is different in what they want, necessitating easy adjustability.

Patent literature related to adjustable highbacks include U.S. Pat. No. 5,713,587 to Morrow, U.S. Pat. No. 6,325,405 to Okajima, U.S. Pat. No. 6,390,492 to Bumgamer, U.S. Pat. No. 7,077,403 to Laughlin and Dodge, and WO 2012/058451 to Morrow. Some of these systems require special keys to operate, and are ratcheted so that adjustment is stepwise instead of smooth. Moreover, these systems are generally specific for snowboards, and lack features as would find use for uphill skiing, simply because uphill skiing is not possible with a snowboard. For uphill touring it is desirable for the highback to recline, allowing the splitboarder maximum stride for efficient travel. The ability to quickly switch between a recline mode and a forward leaning mode is also desirable.

It is an object of the present invention to provide an improved highback suitable for use with a splitboard binding system having both a "ski touring" mode (enabled to perform both downhill and uphill skiing) and a splitboard "ride" mode. There has been a long-standing need for a highback that is more closely adapted for use with splitboards.

SUMMARY

A splitboard boot binding system is provided that comprises a baseplate constructed and arranged to receive a rider's boot and capable of being mounted on a splitboard in either ride mode or ski tour mode. The baseplate assembly includes a "heel cup" for receiving a boot heel, and toe and ankle straps. The improved splitboard boot binding further includes an upright support member, termed a "highback", shaped to contact and support a rider's ankle and calf at a posterior aspect, and having a means for selecting a preferred forward lean bias. The highback includes pivot ears and mounts on the heel cup. Increased forward lean requires the rider to flex at the knees; reduced forward lean allows the rider to stand more upright. The rider adjusts the forward lean bias of the highback according to skiing or riding style and conditions, and according to personal comfort.

No tools are required for adjustment of forward lean bias. A captive jackscrew is mounted from a transverse axle pin inserted into the spine of the highback, such that rotation of a forward lean adjustor block threaded onto the distal end of the jackscrew extends or retracts the strut length (and the highback forward lean angle) in relation to the heel (and baseplate). The threaded adjustor block includes a slotted underside that seats on the top back rim of the heel cup. The adjustor block is supported by the heel cup rim, but can be lifted off the heel cup and inverted so as to quickly disengage the forward bias. A walled channel in the spine of the highback is configured to capture the block in its inverted position when not in use. Reversing this motion allows the adjustor block to be re-seated on the heel cup. A forward lean adjustment can be dialed in by rotating the adjustor block on the captive jackscrew.

Thus in a first exemplary embodiment, the invention is a highback for a splitboard boot binding system with heel cup, which comprises an adjustable length strut mounted at a first end on a pivot pin in a channel running center-back the length of the spine of a highback body member (1*a*, FIG. 8B), the adjustable length strut having a forward lean adjustor block, wherein the block is threadably rotatable on a second end of the captive jackscrew and seats endwise on a top rim of the heel cup, the block acting to extend or retract the strut length and a highback forward lean angle in half turn increments. When not in use, the forward lean adjustor block is enabled to be pivoted to an inverted position on the pivot pin so as to be fully disengaged. Advantageously, the channel at the spine of the highback body is defined by two walls contralaterally disposed thereon, the walls serve to receive and secure the adjustor block in the inverted position and also serve as a pivot cradle for the pivot pin, achieving a synergy of function.

The elements, features, steps, and advantages of the invention will be more readily understood upon consideration of the following detailed description of the invention, taken in conjunction with the accompanying drawings, in which presently preferred embodiments of the invention are illustrated by way of example.

It is to be expressly understood, however, that the drawings are for illustration and description only and are not intended as a definition of the limits of the invention. The various elements, features, steps, and combinations thereof that characterize aspects of the invention are pointed out with particularity in the claims annexed to and forming part of this disclosure. The invention does not necessarily reside in any one of these aspects taken alone, but rather in the invention taken as a whole.

BRIEF DESCRIPTION OF THE DRAWINGS

The teachings of the present invention are more readily understood by considering the drawings, in which.

Figure 1:
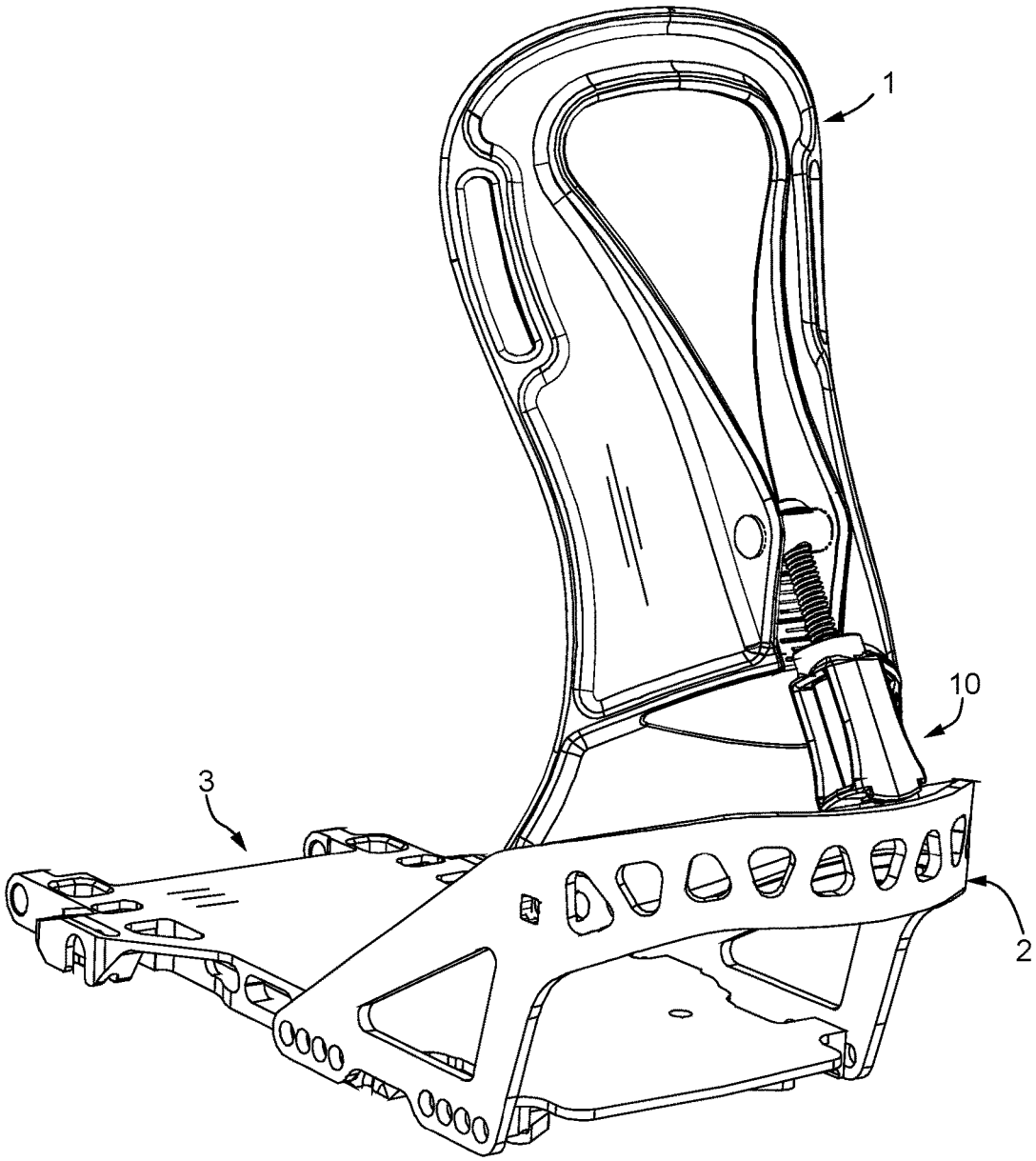
FIG. 1 is a posterior perspective CAD view of a splitboard boot binding system with forward lean adjustor mechanism of the invention.

The drawing figures are not necessarily to scale. Certain features or components herein may be shown in somewhat schematic form and some details of conventional elements may not be shown in the interest of clarity, explanation, and conciseness. The drawing figures are hereby made part of the specification, written description and teachings disclosed herein.

Glossary

Certain terms are used throughout the following description to refer to particular features, steps or components, and are used as terms of description and not of limitation. As one skilled in the art will appreciate, different persons may refer to the same feature, step or component by different names. Components, steps or features that differ in name but not in structure, function or action are considered equivalent and not distinguishable, and may be substituted herein without departure from the invention. Certain meanings are defined here as intended by the inventors, i.e., they are intrinsic meanings. Other words and phrases used herein take their meaning as consistent with usage as would be apparent to one skilled in the relevant arts. The following definitions supplement those set forth elsewhere in this specification.

"Splitboard": a combination consisting of two separable ski members, each generally having one non-linear ski-like longitudinal edge, that can be conjoined at opposing lateral straight edges (defining a board "centerline" or "seam") to form a snow gliding board. The ski members are typically shaped so as to approximate the right and left halves of a snowboard respectively. The tips of the ski members are generally secured together in ride mode configuration by use of hooks, pins, or other conjoining apparatus, but the relative stiffness of the coupling is largely the result of the mechanics of the transverse union formed by the puck system and boot binding hardware straddling the separate ski members.

"Ski tour" or "touring", when used as a noun, indicates a trip through areas typically away from ski resorts, often referred to as "backcountry", which may include traversing flat areas, ascending inclined slopes, and descending slopes. Touring is done using one or several of the following pieces of equipment: skis, poles, snowshoes, snowboards, or splitboards. When used as a verb, it indicates: to enter the backcountry, typically away from a ski resort, and perform one or more of the following: traverse flat areas, ascend inclined slopes, and descend slopes using one or more of the following pieces of equipment: skis, poles, snowshoes, snowboards, or splitboards. With reference to splitboards, the terms "descent mode" and "ski tour mode", have special meaning because the splitboard is provided with interfaces for interchangeably performing both.

A "ski tour mode interface" or "ski binding interface" is a boot binding interface affixed to splitboard or more specifically to the ski members of a splitboard, the interface having a toe pivot bracket or cradle for pivotably mounting a boot binding thereon. The ski tour interface is used for ski touring and cross-country skiing, as may be termed here "ski tour mode". With reference to a splitboard, the term "ski tour mode" indicates a skiing method in which the two ski members of a splitboard are separated and are attached one to a leg, typically with a free heel binding, such as is used to ascend slopes and flats where descent mode is not possible. More generally, a ski tour interface refers to hardware, brackets, pins or blocks secured on the surface of each ski, generally centrally placed, so that boot bindings can be fastened to them, one boot to a ski. In the most common conventional device, a ski touring pin cradle and pivot pin is used with a pivotable boot binding baseplate, the purpose of which is to provide a hinged coupling between the boot and its counterpart ski member, as in telemark skiing and "free heel" skiing. Heel locking devices may also be used, however. A ski mounting block may take the place of the pin cradle and may be used with boot mounting tongues, cables, or other pivoting means. Incorporated herein by reference with respect to pivoting means are U.S. Pat. No. 5,649,722 to Champlin, U.S. Pat. No. 6,685,213 to Hauglin, U.S. Pat. No. 5,741,023 to Schiele, US Pat. Appl. 2005/0115116 to Pedersen, and their cited and citing references. "Ride" or "riding": a noun or verb used by splitboarders and snowboarders to indicate the distinctive descent on snow experienced by a rider on a snowboard (or on a splitboard in ride mode). Snowboarders and splitboarders ride; skiers ski.

A "ride mode binding interface", also termed a "ride mode interface" or perhaps more accurately termed "descent mode interface", is boot binding interface affixed to a board so that a rider can ride downhill on snow with legs apart, knees flexed, and body generally in a side stance on the board. The ride mode interface is used when the board is ridden in the manner of a snowboard. With reference to splitboards, the ride mode interface optionally comprises paired slider block ("puck") assemblies, two for each foot, such that members of each pair are affixed to opposite ski halves of a splitboard, so that when each of a rider's boot bindings are engaged on the paired pucks (the underside channel of the bootbinding engaging mated parallel contralateral superiolateral flanges (the "slider track") of the slider blocks, the ski halves of the splitboard are joined to each other. The "ride mode interface" is preferred for descending snowy slopes, as may be termed here "descent mode".

Other ride mode interfaces compatible with the forward lean adjustor system of the invention include bindings currently made by Voilé, Burton, Karakoram, Ranger, Plum, SP and other binding manufacturers.

"Forward lean" refers to the flexion of the rider's knees, and to an adjustable setting on the highback of a boot binding. Conventionally, the range of adjustment is between zero and about 22 degrees of dorsiflexion, and is typically associated with knee flexion. A zero lean angle relates to an angle between the highback spine and a perpendicular to the baseplate of the boot binding, a positive angle indicating a forward lean mode, a negative angle indicating a recline mode, as for a long stride in ski touring mode.

"Foot roll": is a term used in the art to denote the freedom of angular leg movement experienced by a board rider. The rider uses foot roll to shift the pressure on the board toward the nose or tail on the underlying snow and to control the ride. Foot roll is essentially the "$\Delta\theta$" in the equation for torsional stiffness. Optimizing the stiffness factor K optimizes the control of the ride achieved with foot roll.

"In alternation" or "in turn" refers to the interchangeability of the boot binding system between a ride mode interface and a ski touring mode interface, but may also include switching the system from one gliding board to another board having a compatible interface. Thus any combination of interfaces may be selected in turn because the engagement interfaces enable attachment to any of them.

General connection terms including, but not limited to "connected", "attached", "conjoined", "secured", and "affixed", are not meant to be limiting, such that structures so "associated" may have more than one way of being associated.

Relative terms should be construed as such. For example, the term "front" is meant to be relative to the term "back," the term "upper" is meant to be relative to the term "lower," the term "vertical" is meant to be relative to the term "horizontal," the term "top" is meant to be relative to the term "bottom", "inside" is relative to the term "outside", "toeward" is relative to the term "heelward", "toeside" is relative to the term "heelside", and so forth. Unless specifically stated otherwise, the terms "first," "second," "third," and "fourth" are meant solely for purposes of designation and not for order or for limitation. Reference to "one embodiment," "an embodiment," or an "aspect," means that a particular feature, structure, step, combination or characteristic described in connection with the embodiment or aspect is anticipated to be included in at least one realization of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments.

It should be noted that the terms "may", "can", and "might" are used to indicate alternatives and optional features and only should be construed as a limitation if specifically included in the claims. The various components, features, steps, or embodiments thereof are all "preferred" whether or not it is specifically indicated. Claims not including a specific limitation should not be construed to include that limitation. The term "a" or "an" as used in the claims does not exclude a plurality.

"Conventional" refers to a term or method designating that which is believed known and commonly understood in the technology to which this invention relates.

A "method" as disclosed herein refers to one or more steps or actions for achieving the described end. Unless a specific order of steps or actions is required for proper operation of the embodiment, the order and/or use of specific steps and/or actions may be modified without departing from the scope of the present invention.

Unless the context requires otherwise, throughout the specification and claims that follow, the term "comprise" and variations thereof, such as, "comprises" and "comprising" are to be construed in an open, inclusive sense—that is as "including, but not limited to."

"Adapted to" includes and encompasses the meanings of "capable of" and additionally, "designed to", as applies to those uses intended by the patent. In contrast, a claim drafted with the limitation "capable of" also encompasses unintended uses and misuses of a functional element beyond those uses indicated in the disclosure. Aspex Eyewear v Marchon Eyewear 672 F3d 1335, 1349 (Fed Circ 2012). "Configured to", as used here, is taken to indicate is able to, is designed to, and is intended to function in support of the inventive structures, and is thus more stringent than "enabled to".

The appended claims are not to be interpreted as including means-plus-function limitations, unless a given claim explicitly evokes the means-plus-function clause of 35 USC § 112 para (f) by using the phrase "means for" followed by a verb in gerund form.

Unless otherwise defined, all technical and scientific terms used herein have the same meaning as commonly understood by one of ordinary skill in the art to which this invention belongs. In case of conflict, the present specification, including definitions, will control.

DETAILED DESCRIPTION

Improvements in highback forward lean adjustment are needed to aid a rider in selecting and optimizing a preferred style of riding. For example, responsiveness for heelside carving is aided by a forward lean bias, allowing more turning power and tighter turns, but less forward lean allows a more relaxed and loose posture—because the highback is not forcing the rider maintain knee flexion. Less forward lean may also feel more comfortable, providing freestyle riders with more movement to adjust their posture on the fly. Riders may define a comfort zone for their style of boarding and adjust the highback accordingly. The forward lean adjustor system of the invention can be used with any splitboard or snowboard binding utilizing a pivoting highback and heel cup. Readily adjusted highback forward lean can also improve performance in uphill skiing (also termed "skinning"), where the rider hikes up a slope by alternately pushing each ski ahead. A forward lean adjustor that enables the highback to recline (i.e., with a negative $\Delta\theta$) may allow the rider a longer stride when skinning. Thus a rider may wish to adjust the lean angle periodically, and the ability to do this quickly without tools is an advantage. For some splitboard binding adjustments, a Phillips head screw driver or an Allen wrench are needed, but these are difficult to manipulate in cold weather, particularly while wearing insulated gloves. Advantageously, the inventive mechanism eliminates the need for tools in making adjustments or for disengaging the forward lean bias, and enables the rider to make adjustment even when wearing gloves. Highbacks are used in conjunction with climbing bars to adjust the rider's leg angle when climbing. These and other features are described with reference to the figures and accompanying description and claims.

Figure 2:
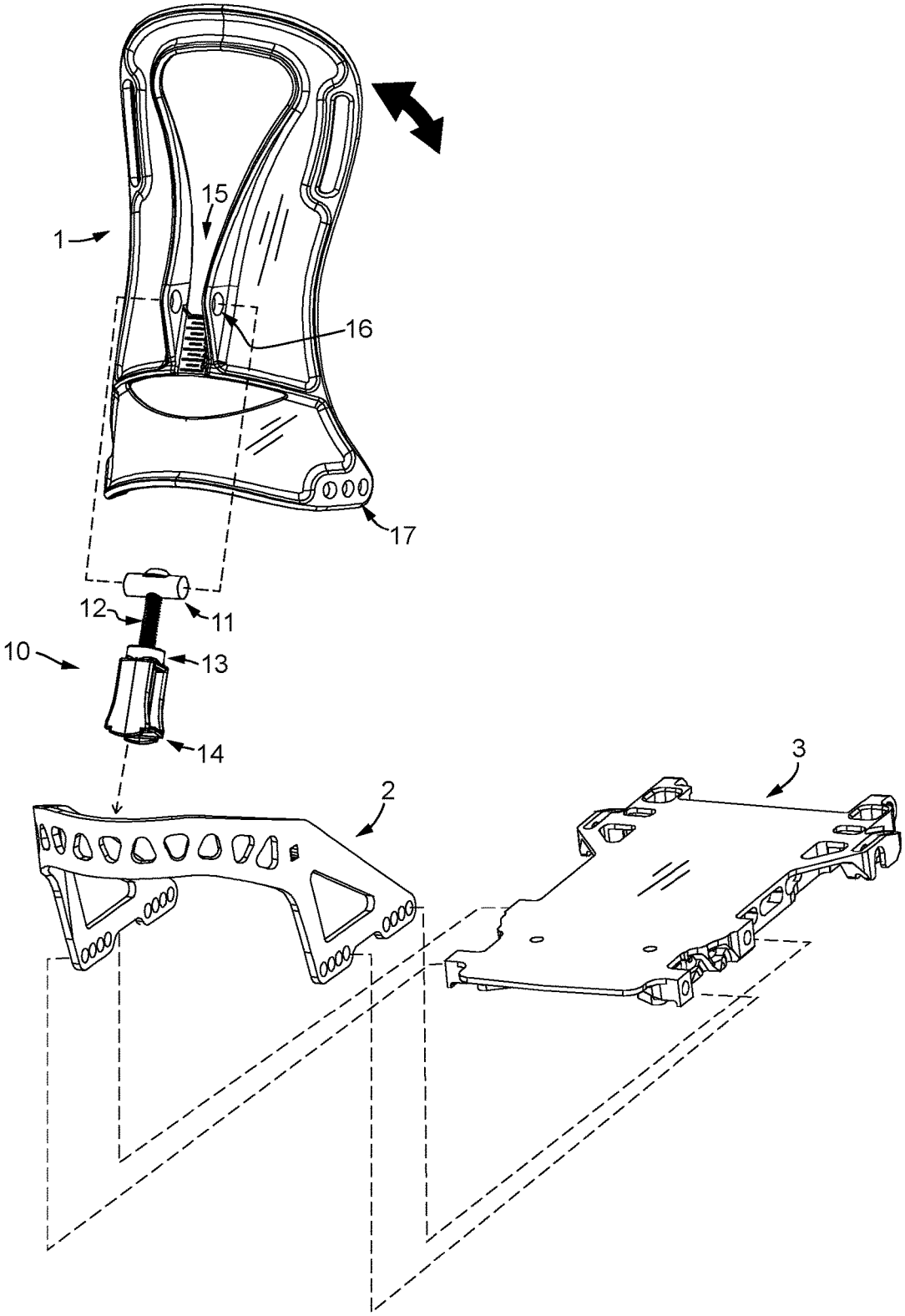
FIG. 2 is an exploded view of a highback with forward lean adjustor mechanism as disposed on a boot binding system with heel cup and baseplate.

Referring to FIG. 1, a posterior perspective CAD view of a splitboard boot binding 100 is illustrated, with forward lean adjustor 10 of the invention. A pivotable highback 1 and heel cup 2 support the system. The heel cup is mounted on a boot binding baseplate 3 on which the rider's foot rests and the highback body is attached to the heel cup at forward pivot ears. Angulation of the highback is achieved with the forward lean adjustor, which serves as a variable length strut. FIG. 2 is an exploded view of a highback body 1 with forward lean adjustor 10 as disposed on a boot binding with heel cup 2 and baseplate 3. The forward lean adjustor assembly is drawn in isolation, and includes a transverse pivot pin 11, jackscrew 12 (with buttonhead cap), and a captive nut 13 that engages a forward lean adjustor block 14. Collectively the forward lean adjustor assembly 10 defines an adjustable length strut between the highback body and the top rim of the heel cup (when engaged). The pivot pin is threadedly mounted on a first end of the jackscrew; the adjustor block on a second end, and generally only the adjustor block is rotated to adjust the strut length.

Center channel 15 is defined by raised walls that function as a pivot cradle, indicated here by pivot holes 16. The raised walls strengthen the spine of the highback body, support the pivot pin, and provide a means for securing the adjustor block when not in use. Also visible in the center channel 15 is a ruled section with indicia used for reference in making adjustments, such as for dialing in a preferred setting for certain riding conditions. Dashed lines indicate assembly (some fasteners are not shown for clarity).

The highback is provided with two pivot ears 17 (shown here with multiple selectable positions) on which it rotates when extended by the action of the adjustable length strut. The heel cup includes mating pivot members for engaging the highback pivot ears, as known in the art. Fasteners for securing the heel cup to the baseplate 3 are not drawn for clarity.

Figures 3A, 3B:
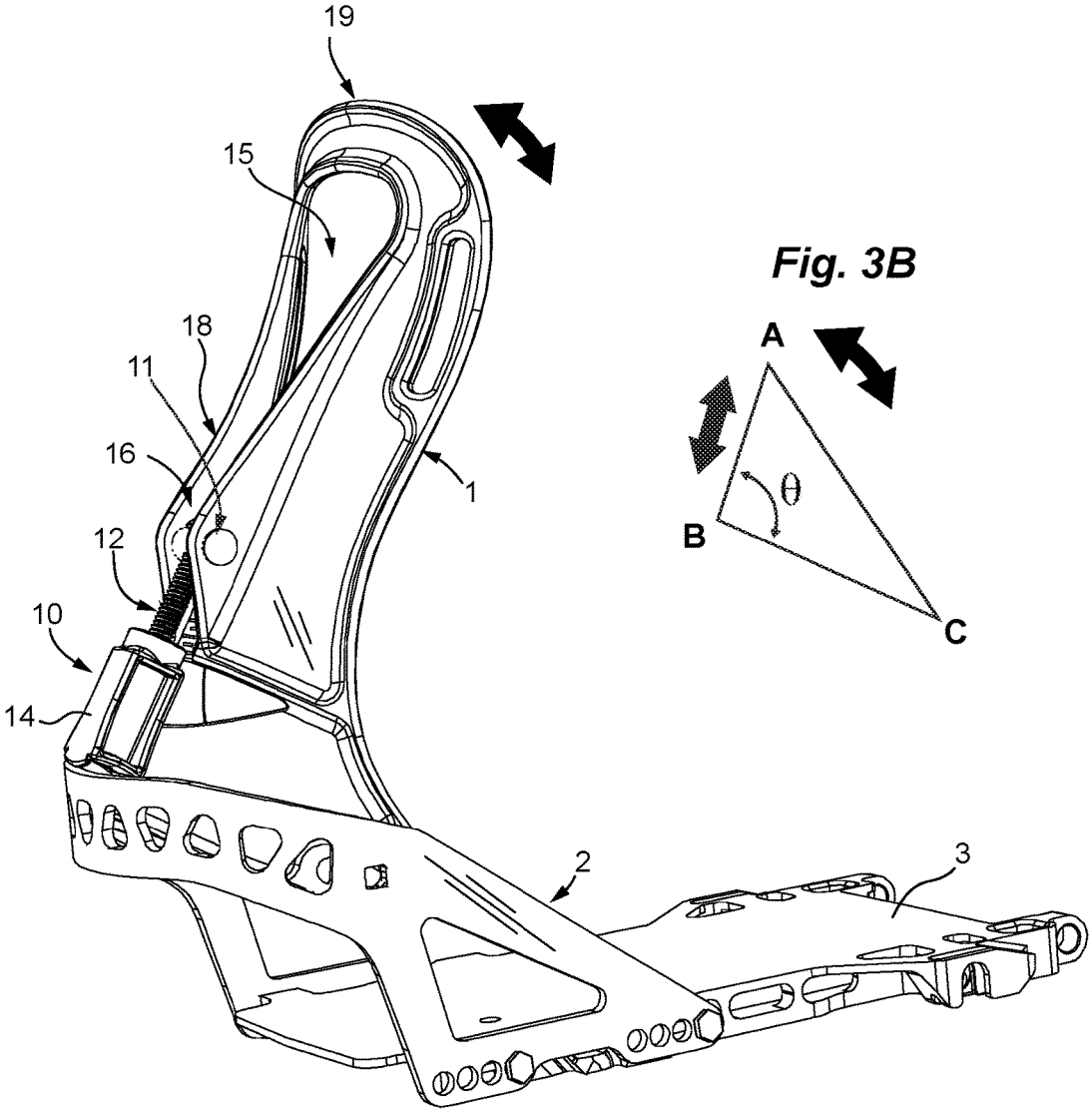
FIG. 3A is a perspective view of a forward lean adjustor coupled to a highback and seated on a heel cup. Figuratively, operation of the forward lean adjustor is represented in FIG. 3B.

FIG. 3A is another rendering demonstrating the workings of a forward lean adjustor 10 coupled to a highback. The rider may reduce or increase the forward bias by rotating the adjustor block 14 on the captive jackscrew 12.

The highback body includes two walls 18 on either side of channel 15 that run up the spine (1*a*, dashed line, FIG. 8B) of the backside of the highback body. The two reinforcements or ribs form a pivot cradle (holes, 16) for receiving the transverse pivot pin 11 at the top head of the jackscrew 12. This axle couples the rotatory extension and retraction of the jackscrew 12 to a forward lean (bold arrow) of the highback on its pivot ears. Channel 15 is closed at the top of the highback body, forming a convenient handle 19. Thus the structure provides a synergy of functions in a compact and rugged assembly.

Figure 12A:
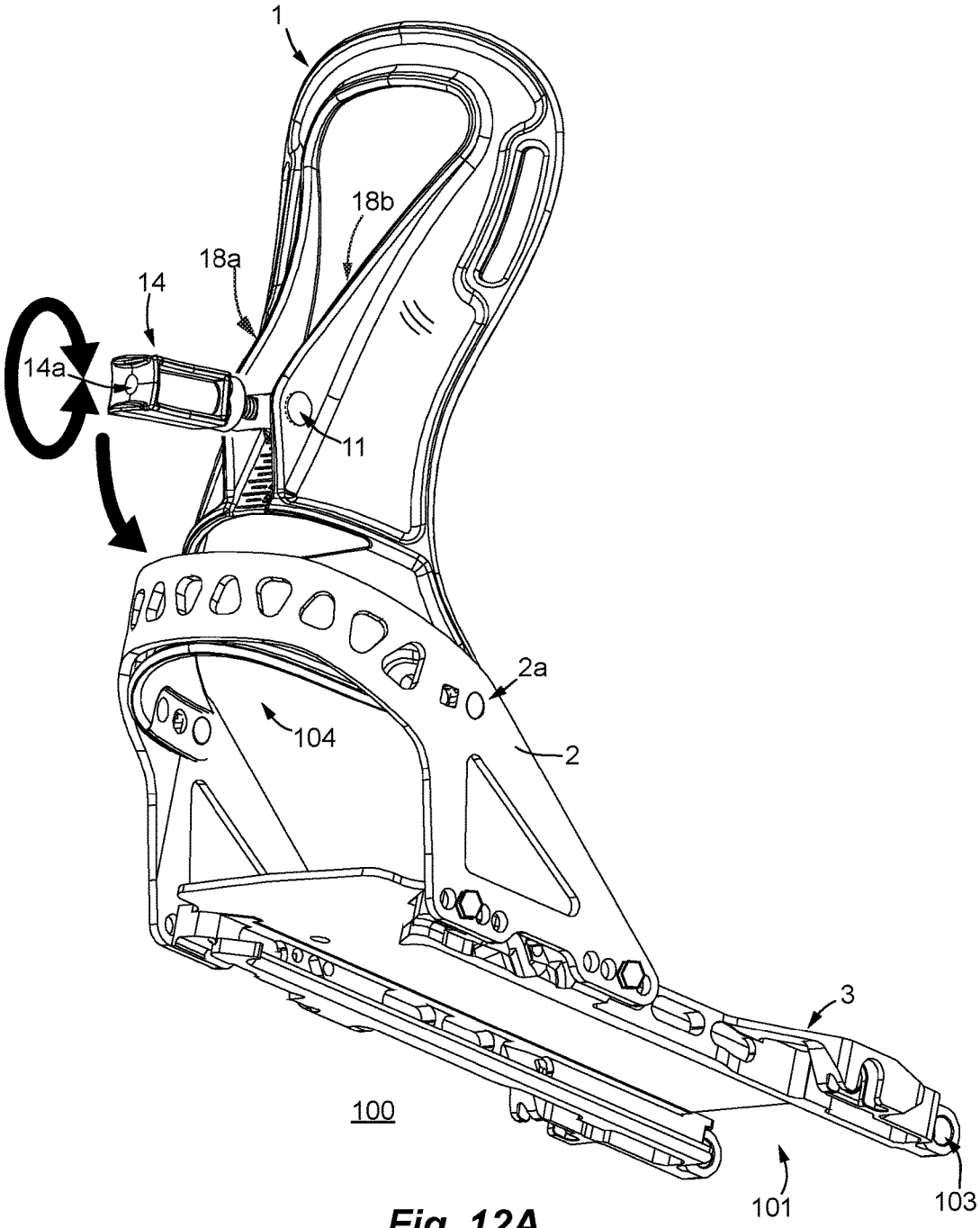
FIG. 12A is an action view showing the method by which the adjustor block can be rotated manually to extend or retract the forward bias and to disengage the system.

Figuratively, operation of the forward lean adjustor is represented in FIG. 3B. Point A represents the pivot pin cradle 16, point B represents the endwise seat of the adjustor block 14 on the top rim of the heel cup, and point C represents the pivot ear angulation axis 17 of the highback body 1. Triangle segment A-B may be varied in length; thus the angulation at C is selectable over a range corresponding to the length of the jackscrew and adjustor block combination as indicated by the bold arrows. Using a threaded adjustor block on the jackscrew provides a compactness of construction and reduces snow impaction of the mechanism. Using a threaded pivot pin allows for added function to stow the adjustor block—it simply is rotated to an inverted position and secured in channel 15. No tools are needed, when strapped in, the rider can reach back and squat down to adjust the forward lean bias by rotating the threaded adjustor block clockwise or counterclockwise on the jackscrew as shown in FIG. 12A.

FIG. 3B figuratively also represents the angulation of the highback relative to the heel cup. Angle theta (θ) can range from a positive angle as for forward lean to a negative angle, as for negative lean, as needed. The negative lean, also termed "recline mode" is achieved by winding the adjustor block 14 further onto the jackscrew 12 and then seating the block on the heel cup 2 so that the angulation is positive or negative.

Figure 4A:
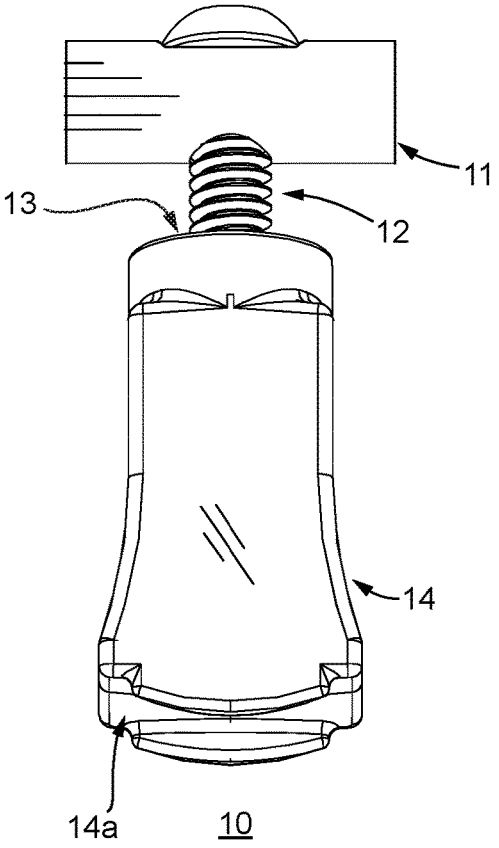
FIGS. 4A and 4B are detail views of the assembly of a forward lean adjustor mechanism.
Figure 4B:
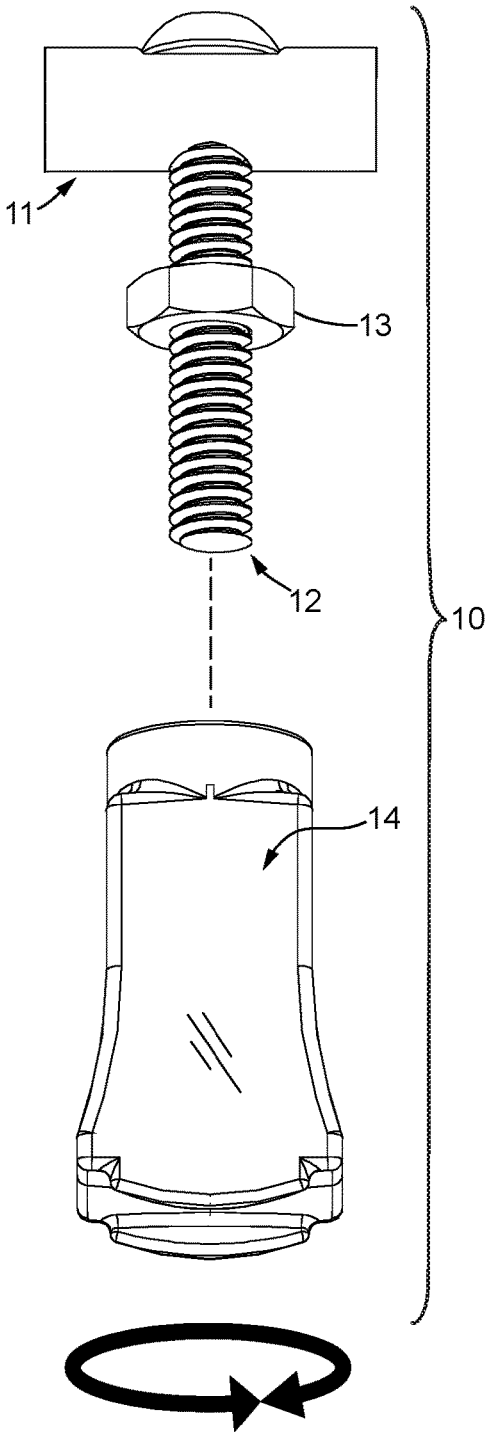
Figure 5A:
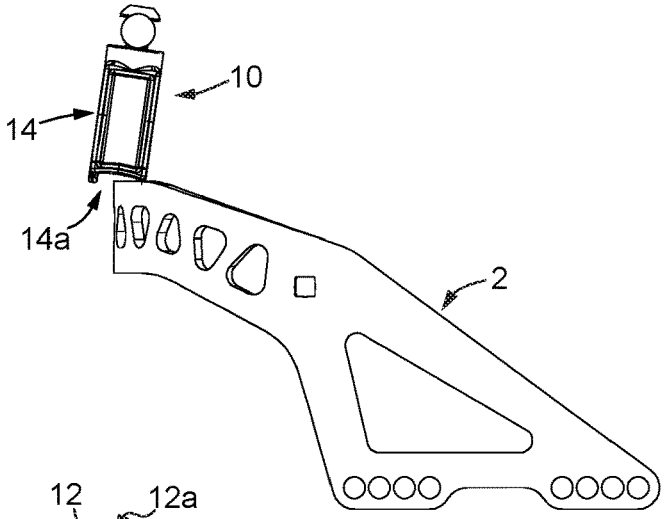
FIGS. 5A, 5B and 5C are views of a forward lean adjustor block resting on the rear lip of the heel cup.
Figure 5B:
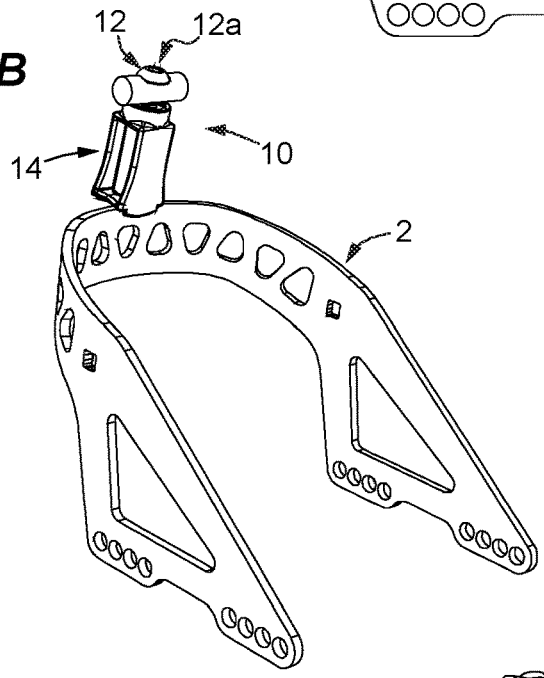
Figure 5C:
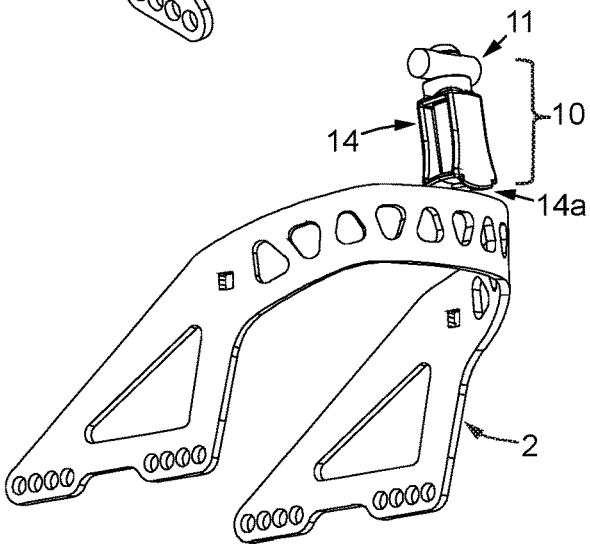

FIGS. 4A and 4B are detail views of the assembly of a forward lean adjustor. FIG. 4A shows the completed assembly 10. Jackscrew 12 is threaded through a threaded sleeve in pivot pin 11; forward lean adjustor block 14 is threaded onto the other end of the screw. A captive nut 13 couples the threads on the screw to the block. The forward lean adjustor assembly acts essentially as an adjustable strut that is extensible and retractable by winding the forward lean adjustor block in or out on the screw. Lengthening the strut results in increased forward lean, shortening the strut reduces the forward lean. At the base of the adjustor block is a slot 14*a* that rests on the top rear edge of the heel cup 2 as shown in FIGS. 5A, 5B and 5C when engaged, preventing unwanted rotation or slippage. In this way, any force exerted on the highback is coupled through the heel cup 2 to the baseplate 3 and the board.

FIG. 4B is an exploded view showing the captive jackscrew 12 and captive nut 13, the transverse pivot axle 11, and the forward lean adjustor block 14 making up the forward lean adjustor sub-assembly 10. As will be described below, block 14 is rotated on the screw (bold arrow) to adjust the forward lean bias. Nut 13 is locked in the block 14 and threads up and down jackscrew 12 to lengthen or shorten the strut. Other means for adjusting strut length without tools are contemplated, but the jackscrew provides a level of fine adjustment dependent on the thread pitch.

FIGS. 5A, 5B and 5C are views of a forward lean adjustor block 14 resting on the rear top rim of the heel cup 2. The underside slot 14*a* on the adjustor block is again illustrated engaging the rim of heel cup. At the top of jackscrew 12 is a buttonhead 12*a* with provision for using an Allen wrench to lock the screw and pivot pin together during setup. In the field, adjustment may be made manually by turning the adjustor block 14 at the bottom so that the nut threads up and down the screw to change the length. The combination of pivot axle 11, forward lean adjustor block 14, jackscrew 12 and captive nut 13 is termed the "forward lean adjustor sub-assembly" 10 as shown in FIG. 4B.

Figure 6B:
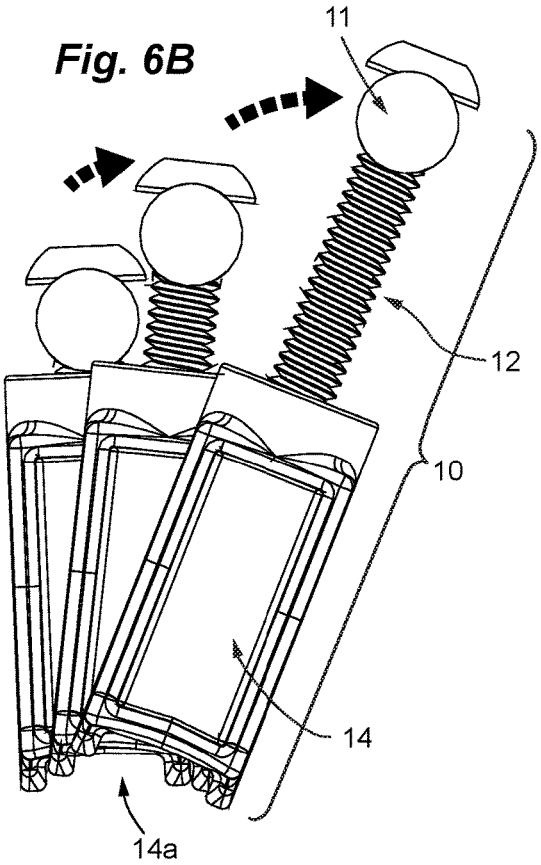
FIGS. 6A and 6B are action views showing the action of the forward lean adjustor block on a captive jackscrew; here driving the highback into a steep forward lean.
Figure 6A:
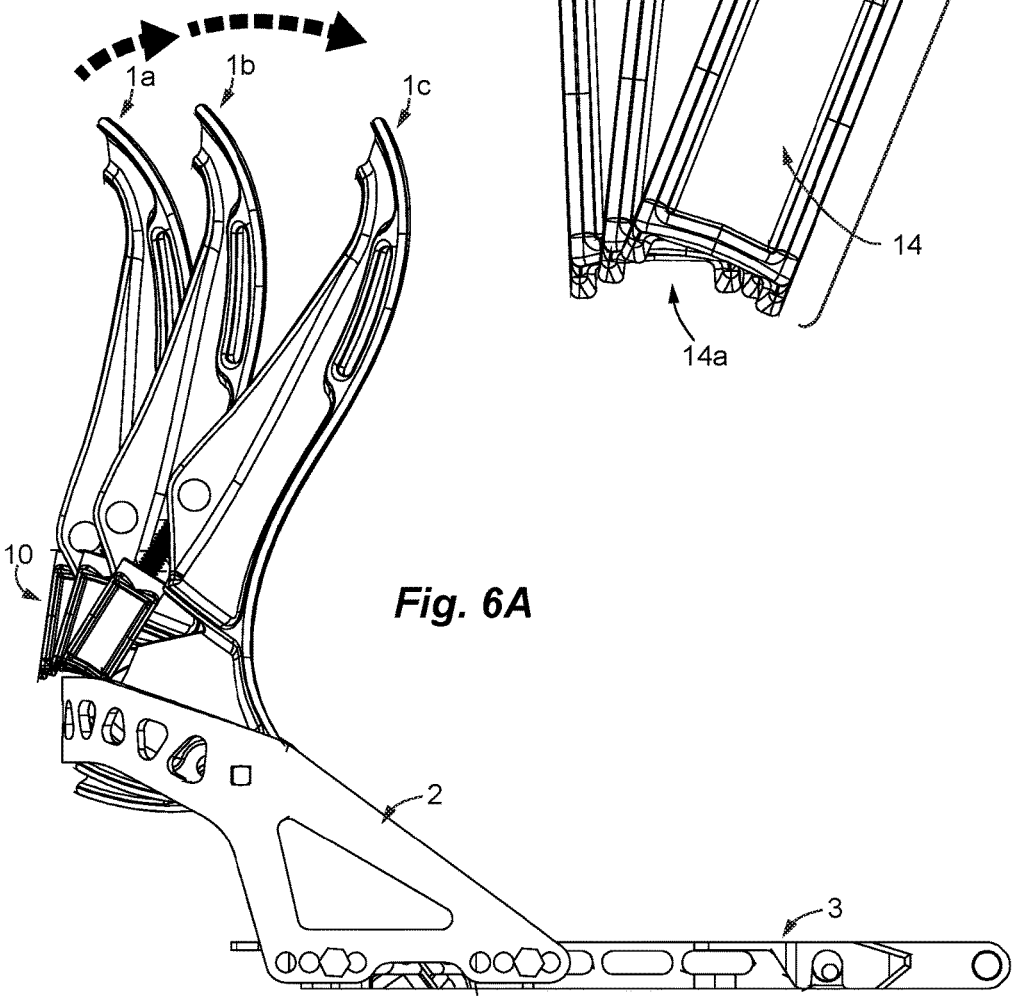

FIGS. 6A and 6B are action views showing the rotary pivot action of the adjustor block on a captive screw, here driving the highback into a steep forward lean angle. Adjustment of the highback over about thirty degrees of positive forward lean angle may be achieved. By configuring the jackscrew and adjustor block, a slight negative lean may also be achieved if desired for powder riding with full leg extension.

This view also shows the underside slot 14*a* in the adjustor block as engaged on the heel cup rim and as seen in profile in FIG. 6B. As currently practiced, jackscrew 12 is an M6×1 mm pitch screw or 25.4 threads per inch in Imperial units, and is threaded into pivot pin 11. The thread pitch determines the fineness of adjustment, each half turn of adjustor block 14 is an increment decreasing or increasing the length of the forward lean adjustor strut 10. The total length of the jackscrew need not be long, sufficient adjustment is achieved with a 40 mm buttonhead cap screw. By selecting the bolt length, forward angulation is limited to about 22 degrees from upright, as is sufficient for the vast majority of riders.

Also a feature of the inventive forward lean adjustor and highback combination is the capacity to reverse the lean so that a "negative forward lean angle" is achieved. The ability to quickly switch between a positive forward lean angle or "mode" and a negative forward lean angle or "recline mode" is also desirable. The recline mode for example can be used by riders in making "surf style" turns in deep snow, such as with a swallowtail board in powder or to enable a long stride while skinning. By selecting the range of motion of the adjustor block on the jackscrew or by moving the pivot axis up on the spine of the highback, negative lean angles are obtained. As currently practiced, fully disengaged, only the boot limits plantar flexion and dorsiflexion during riding or touring.

Highbacks of the invention are shown with channel 15 and pivot pin 11 integrated into the construction. The highback is defined by a body member with spine extending at the posterior of the body from top to bottom. However, the concept extends also to constructions made of two or more segments that operate to form an extensible truss for enabling forward lean adjustment and to constructions made with alternatives to a jackscrew, such as a piston with locking ring and optional spring or dampener, an extensible rod with spaced detents, and so forth. Alternatively, the highback comprises an adjustable length strut mounted on a pivot pin rotatably mounted in pivot ears forming a pivot pin cradle transversely disposed or affixed along the spine of the highback body, the adjustable length strut having a forward lean adjustor block, wherein the block is lockably slideable or moveable on the strut and seats endwise on a top rim of the heel cup, the block slideably or moveably acting to lockably extend or retract the strut length, and further wherein the block is enabled to be pivoted to an inverted position on the pivot pin so as to be fully disengaged.

Figure 7A:
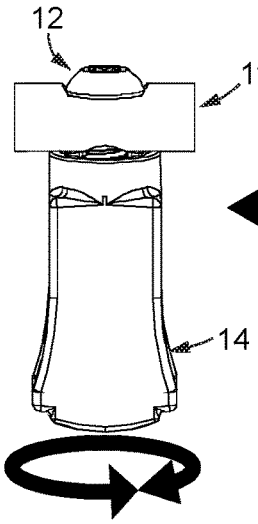
FIGS. 7A, 7B and 7C are detail views illustrating rotational extension of the forward lean adjustor axle on the captive jackscrew.
Figure 7B:
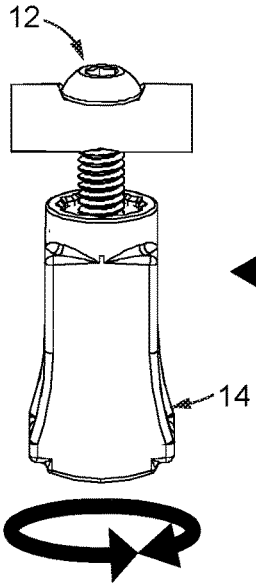
Figure 7C:
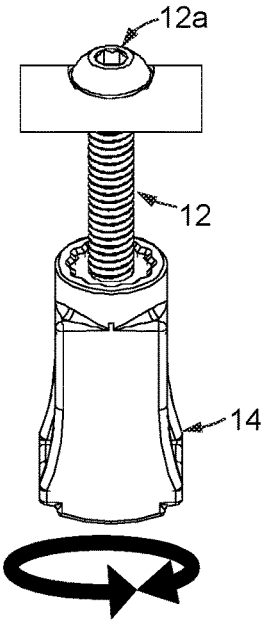

FIGS. 7A, 7B and 7C are detail views illustrating the reversibly extensible screw mechanism for adjusting the forward lean. Extension and retraction are completely reversible and are readily achieved by winding or unwinding the adjustor block 14 on jackscrew 12. Bold arrows indicate the winding motion. In this instance turning the adjustor block clockwise threads the captive nut 13 closer to the buttonhead 12*a;* turning the adjustor block counterclockwise retracts the captive nut 13 from the button head.

Figure 8A:
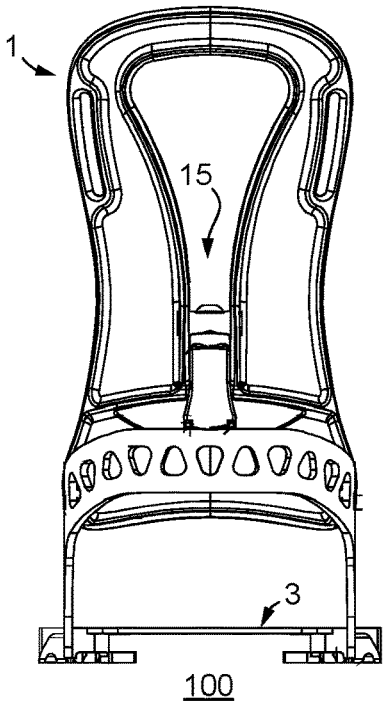
FIGS. 8A and 8B compare rear views of the forward lean adjustor in a fully retracted (FIG. 8A) and a fully extended (FIG. 8B) position.
Figure 8B:
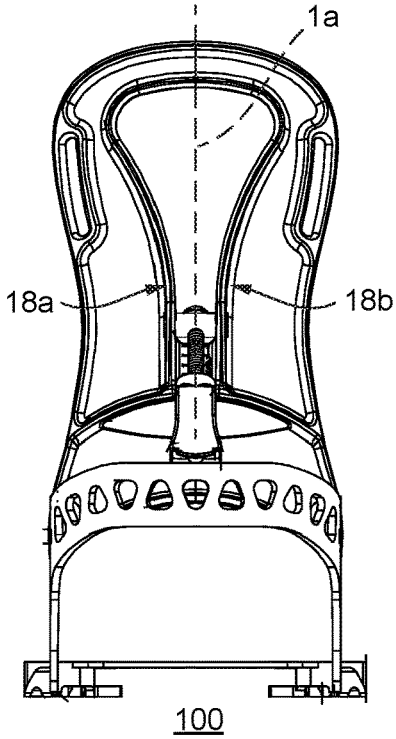
Figure 10:
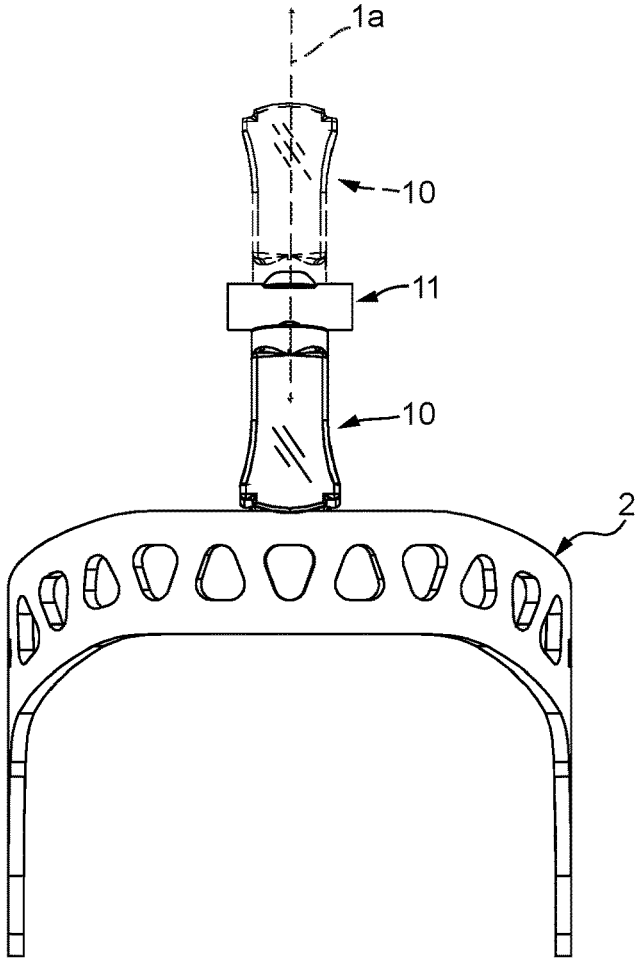
FIG. 10 demonstrates that the forward lean adjustor block can be rotated 180 degrees on its transverse pivot axle; disengaging the endwise seating of the adjustor block on the top rim of the heel cup.

FIGS. 8A and 8B compare rear views of the highback with forward lean adjustor block in a fully retracted (FIG. 8A) and a fully extended (FIG. 8B) position. Channel 15 in the highback 1 is provided to receive the adjustor block when flipped up and inverted on its pivot axle. Two walls (18*a*,18*b*) bordering channel 15 aid in securing the adjustor block when stowed as shown in FIG. 10, where the spine 1*a* of the heelback is indicated for reference. When secured in the channel, any forward bias is fully disengaged and the block is secured out of use. Comparing FIGS. 8A and 8B, the baseplate 3 is completely flat relative to the heel cup, but the highback is forced into a forward angulation by extending the strut (as shown on the right).

Figure 9:
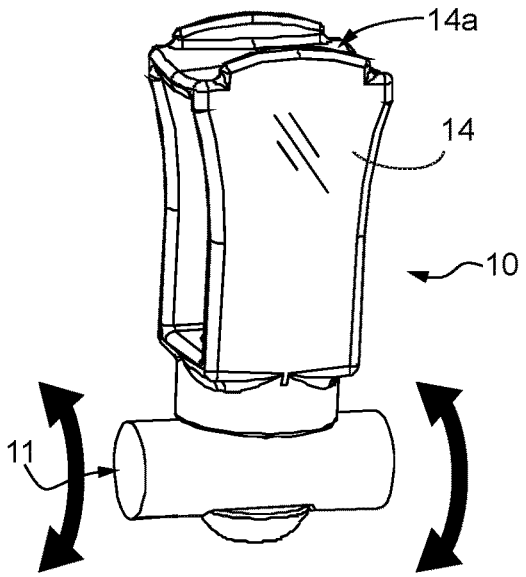
FIG. 9 is a detail view of the forward lean adjustor block in an inverted, disengaged position.

FIG. 9 is a detail view of the forward lean adjustor 10 in an inverted, disengaged position. In this view, the block 14, which otherwise is typically pendant from pivot axle 11, is now standing on its head, and slot 14*a* is visible on top. Bold arrows indicate the rotary motion on the pivot axle. In an inverted position as shown, the mechanism no longer serves as a strut with endwise detent to bias the rider's leg into a flexed position.

FIG. 10 shows again that the forward lean adjustor can be rotated about 180 degrees on its transverse pivot axle. Block 10 is drawn in a first downward position (solid lines) and in a second inverted position (dashed lines) indicating rotational freedom. The axis of rotation is formed by pivot axle 11 that is pivotably mounted in the walls of channel 15 in the highback as described earlier. Heel cup 2 is shown for reference. Thus surprisingly, the pivot axle 11 serves both for adjustment of the strut length and as a convenient pivot for entirely disengaging the strut from the heel cup and conveniently stowing the adjustor block in channel 15, which is formed in the highback for that purpose (FIGS. 8A and 8B).

Figure 11A:
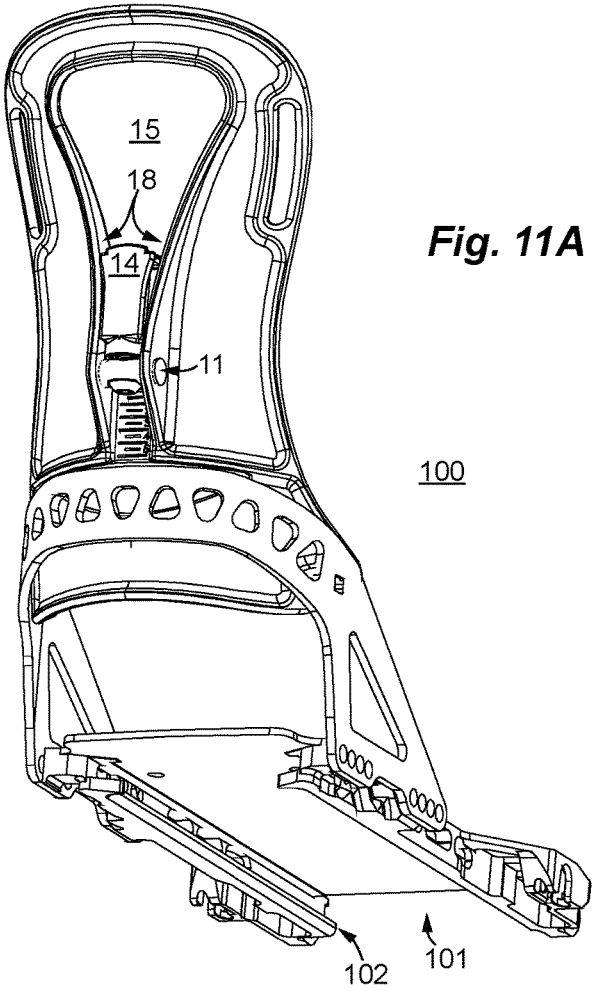
FIG. 11A illustrates the adjustor assembly in an inverted, disengaged position as held in a mating channel in the highback.
Figure 11B:
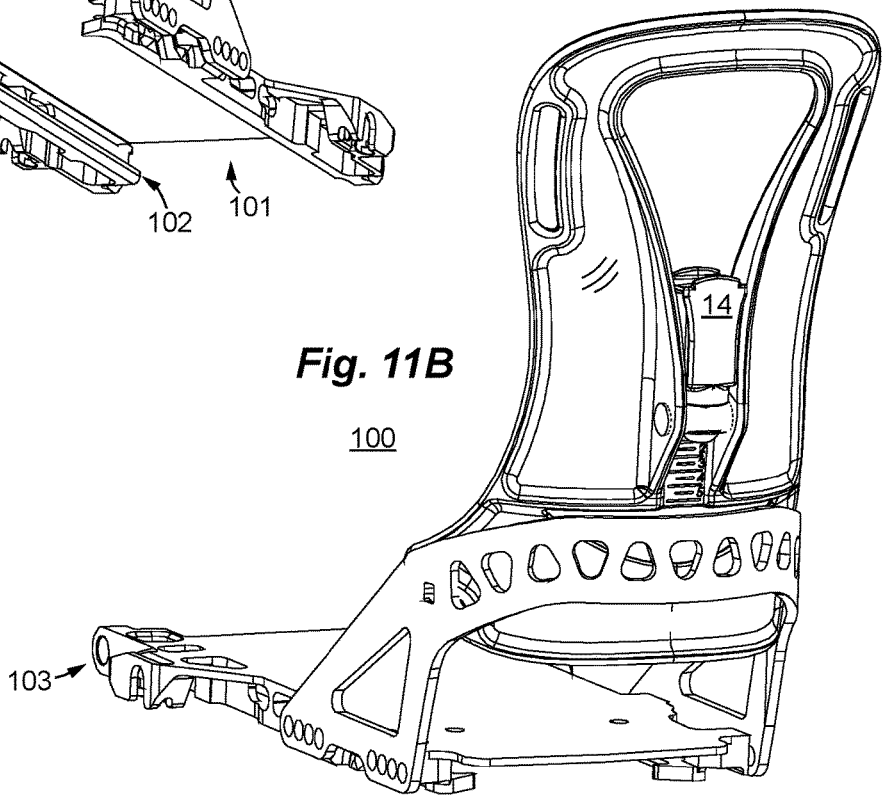
FIG. 11B is another view of the mechanism in a disengaged vertical position.

FIG. 11A illustrates the adjustor block 14 in an inverted, disengaged position as held in channel 15 (where walls 18 of the channel are indicated by branched arrows) in the highback. The axis of rotation for inversion is at 11, the center of the pivot cradle. FIG. 11B is another view of the adjustor block 14 in a disengaged inverted position. In this configuration, the highback is passively coupled to the rider's leg and provides no forward bias. The lower edge of the highback will engage the heel cup, providing a maximum level of mobility for the rider's ankles and thus an optimal stride when the rider's boot is strapped on the binding baseplate. Not shown are ankle straps that secure the rider's boots in the heel cup. Identified here is baseplate underside channel 101 with internal lateral flanges 102 as are compatible with "puck systems" used as "ride mode interfaces" and are described in U.S. Pat. Nos. 7,823,905, 8,226,109 and in U.S. Pat. No. 9,022,412 to Ritter, and U.S. Pat. No. 5,984,324 to Wariakois, all said patent documents being incorporated in full by reference, but the invention is not to be construed to be limited to this style 100 of boot binding baseplates.

FIG. 12A is an action view showing a method by which the forward lean adjustor block can be rotated manually to extend or retract the forward bias. The operation may be achieved with a gloved hand, for example and requires no tools. Manual adjustment allows the adjustor block for example to be spun rapidly to lengthen up the strut, as when firm snow conditions are encountered on a descent and the rider is in need of quickly increasing the forward lean bias.

In this method the adjustor block 14 is extended out from the highback. Winding the adjustor block clockwise or counterclockwise shortens or lengthens the assembly. The block with underside slot 14*a* is then re-engaged on the top rim of the heel cup 2. Two walls (18*a*,18*b*) bordering channel 15 aid in securing the adjustor block when stowed. Essentially, the adjustor mechanism functions as a variable length strut in biasing forward lean. Depth markings allow the rider to quickly make changes based on past experience, but the adjustment also can be made by feel; adjustment takes only a few seconds and can be repeated to get comfortable before continuing on.

Thus the invention is also a method, which comprises (a) providing a splitboard boot binding system with baseplate, toe and ankle straps, and heel cup; (b) providing a highback having an adjustable length strut mounted on a pivot pin in a channel in back of a highback body member, the adjustable length strut having a forward lean adjustor block, wherein the block is threadably rotatable on a captive jackscrew affixed to the pivot pin and seats endwise on a top rim of the heel cup; and (c) extending or retracting the strut length and a highback forward lean angle in half turn increments by rotating the forward lean adjustor block clockwise or counterclockwise on the jackscrew.

More generally, the method for adjusting forward lean angle comprises (a) providing a splitboard boot binding system with baseplate, toe and ankle straps, and heel cup; (b) providing a highback having a body member with backside spine and a strut extending posteriorly therefrom, the strut comprising a forward lean adjustor block, wherein the strut is hingedly mounted on a pivot axle disposed or affixed to the spine, the adjustor block has a seat configured to sit endwise on a top rim of the heel cup; and the block is configured to be adjustably positioned to adjust the length of the strut; and, (c) extending or retracting the length of the strut by adjustably positioning the forward lean adjustor block on the strut to adjust the forward lean angle. The length of the strut may be adjusted by slideably or rotatably positioning the forward lean adjustor block on the strut. The pivot axle may be a pivot cradle having two pivot ears and a pivot pin transversely mounted between the pivot ears in which the pivot cradle is disposed or affixed to the spine. In some embodiments, the strut is threaded at least in part, and the adjustor block is threadedly mounted on the strut and method comprises rotatably adjusting the strut length. In other exemplary methods, the threaded strut is a captive jackscrew, the block is threadably rotatable on the captive jackscrew, and the screw is affixed to the pivot pin, and includes a step for threadably rotating the block on the screw to extend or retract the strut length and then re-seating the block on the top rim, whereby the forward lean angle is adjusted in half turn increments. The method may also involve inverting the forward lean adjustor block on the pivot axle so as to be fully disengaged, whereby the highback is free to angulate on its pivot axis. In other embodiments, the spine comprises two contralaterally disposed walls that define a channel therebetween, and further wherein the walls are configured to receive and secure the block in an inverted position. Essentially, the two walls define a pivot cradle, the pivot pin is mounted transversely between the walls, and the walls serve to retain the adjustor block when disengaged. There may also be a step for selecting a "recline mode" defined by a "negative forward lean angle". And in an alternate method, the step for extending or retracting the length of the strut is achieved by sliding the forward lean adjustor block up or down on the strut and locking the block in place.

The full assembly 100 (including all elements of splitboard boot binding) may be sold with a variety of heel cups 2 and baseplates 3. In this view, baseplate 3 is provided with an underside flanged channel 101, as is currently preferred for practice of the invention, but is not limited thereto. Ankle and toe straps are used to secure the boot to the baseplate 3, which is shown here with a pair of toe pivot holes 103 for free heel skiing. Also shown in this view is a volume 104 surrounded by the heel cup for receiving the heel of a rider's boot. Thus the invention is realized not only in modified and improved highbacks in combination with the forward lean adjustor sub-assembly 10, but also as combinations with highbacks, boot bindings, heel cups and baseplates intended for use with any of the various ride mode interfaces and ski tour interfaces as known in the art.

Figure 12B:
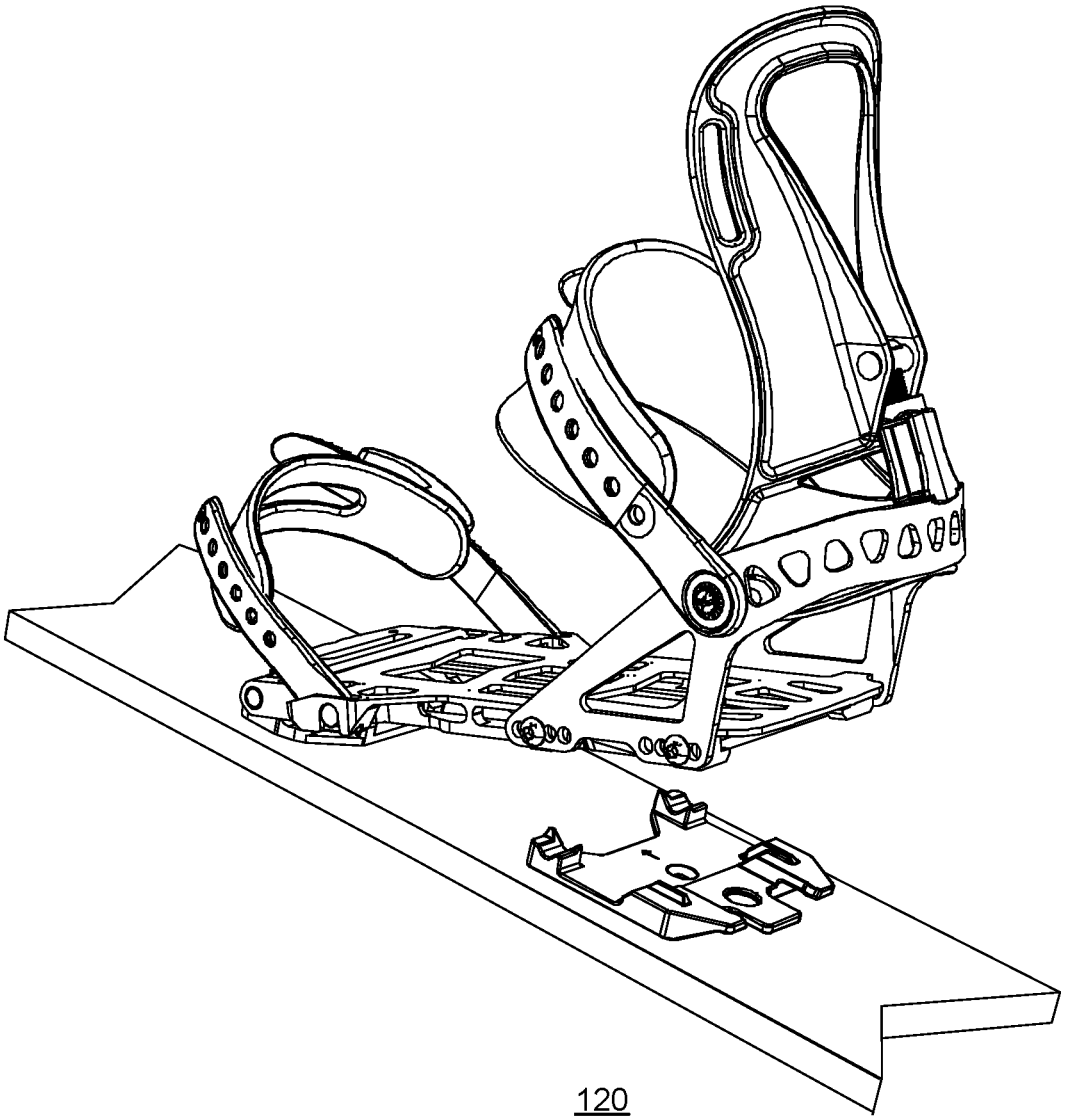
FIG. 12B is a field-of-use view of a forward lean adjustor.

Alternatively, the improved highback with forward lean adjustor sub-assembly 10 may be sold separately as a kit for retrofit to boot bindings already in service. The highback toe pivot ears need only be compatible with a mating highback angulation (pivot) feature 2*a* of the heel cup 2. A highback pivot feature 2*a* is shown figuratively here but various such features are known in the art. FIG. 12B shows the forward lean adjustor with extensible strut in its "field of use", mounted on a splitboard boot binding as a combination 120 with toe pivot and board member. While details of the splitboard boot binding are shown, the method of operation of the extensible strut may be generalized to other boot bindings having a heel cup and a highback, so that the principle of the concept is not limited to the structural particulars shown here.

Figure 13A:
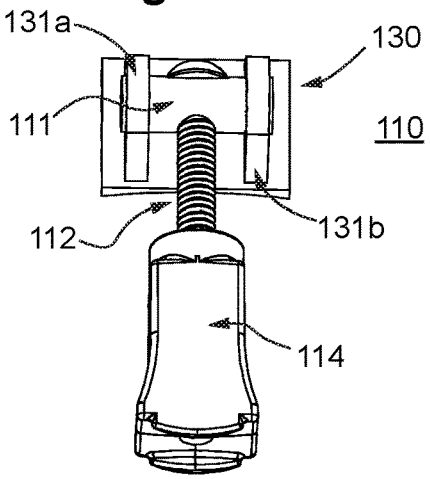
FIGS. 13A, 13B, 13C, 13D, and 13E show an alternate construction.
Figure 13B:
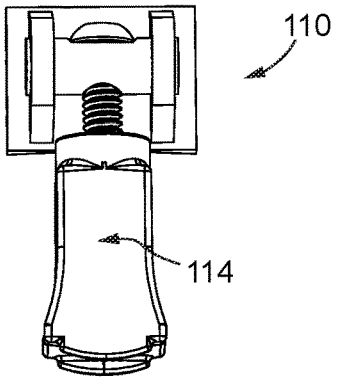
Figure 13C:
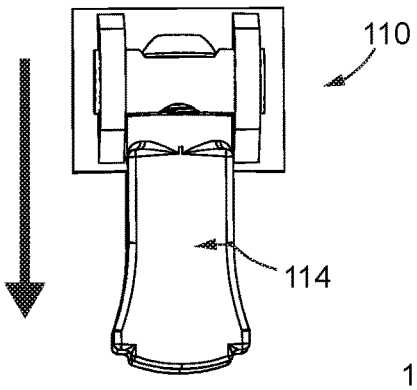
Figure 13D:
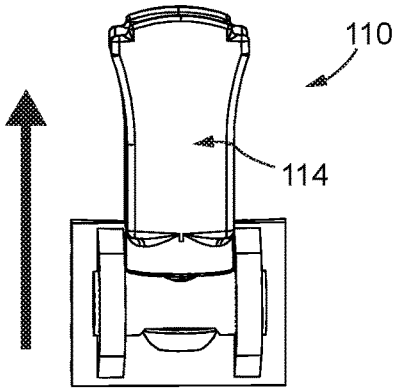

FIGS. 13A, 13B, 13C, 13D, and 13E show an alternate construction. In FIG. 13A, the components of a forward lean adjustor sub-assembly 110 are labeled. At the top, a pivot mechanism 130 consisting of pivot ears 131*a* and 131*b* supports a transverse pivot pin 111, jackscrew 112 (with buttonhead cap), and forward lean adjustor block 114 with integral captive nut. The pivot mechanism is configured to allow adjustor block 114 to rotate from a down position (arrow) as in FIG. 13C to an "up" position (arrow) as in FIG. 13D, i.e., from an engaged position to a disengaged position. Collectively the forward lean adjustor sub-assembly 110 defines an adjustable length strut between the highback body and the top rim of the heel cup (when engaged) and can be varied in length as demonstrated by comparing FIG. 13A with FIGS. 13B and 13C, in which the strut length is taken up by threading the adjustor block onto jackscrew 112. In FIG. 13C, the adjustment mechanism actually achieves a negative angle that defines a "recline mode" as described earlier. The pivot pin is threadedly mounted on a first end of the jackscrew; the adjustor block on a second end, and the adjustor block (with captive nut) is rotated to adjust the strut length. A pivotable highback 1 and heel cup support the system. The heel cup is mounted on a boot binding baseplate on which the rider's foot rests and the highback body is mounted on the heel cup at a forward pivot axis, shown here figuratively by forward pivot ears 133 that engage the heel cup. Angulation of the highback is achieved with the forward lean adjustor block, which serves as a variable length strut, as described earlier. Flipping the adjustor block 114 into the up position as shown in FIG. 13D allows for more negative lean with a greater reclining angle.

Figure 13E:
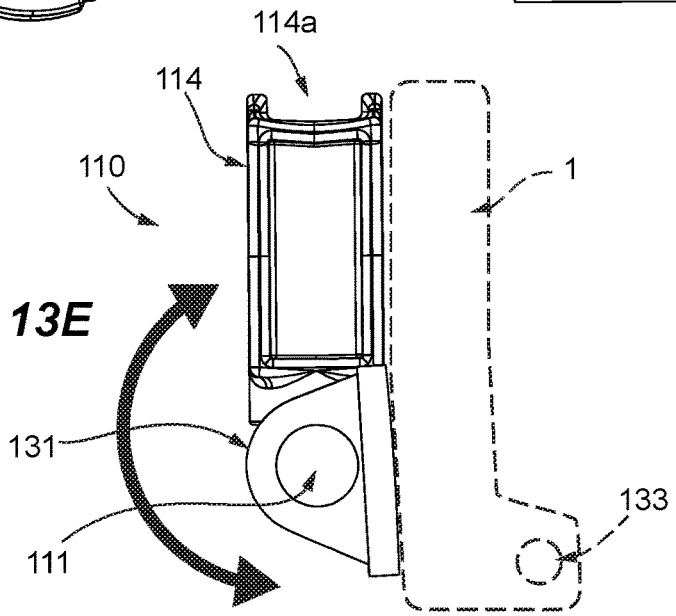

FIG. 13E figuratively illustrates a generalized method of construction of a variable length forward lean adjustor. The pivot cradle 131 is affixed to highback 1 using fasteners, adhesive, or by a fusion, molding or shaping process and is aligned so that the slot 114*a* of the forward lean adjustor block is disengaged in the up position as shown, but when rotated downward (double headed arrow) reversibly engages the upper lip of the heel cup, which provides a rigid support and enables the rider to adjust the forward lean in a range of angles from positive to negative according to personal preference and trail conditions. The mechanism is not inherently limited to a channel with walls supporting the pivot axle as shown earlier, but may be applied more generally to highbacks in need of variable forward lean adjustment. While a jackscrew 112 is a simple and elegant means to achieve variable strut length, a piston with lock ring is another option, and the practice of the invention is not limited thereto.

INCORPORATION BY REFERENCE

All of the U.S. Patents, U.S. Patent application publications, U.S. Patent applications, foreign patents, foreign patent applications and non-patent publications referred to in this specification and related filings are incorporated herein by reference in their entirety for all purposes.

SCOPE OF THE CLAIMS

The disclosure set forth herein of certain exemplary embodiments, including all text, drawings, annotations, and graphs, is sufficient to enable one of ordinary skill in the art to practice the invention. Various alternatives, modifications and equivalents are possible, as will readily occur to those skilled in the art in practice of the invention. The inventions, examples, and embodiments described herein are not limited to particularly exemplified materials, methods, and/or structures and various changes may be made in the size, shape, type, number and arrangement of parts described herein. All embodiments, alternatives, modifications and equivalents may be combined to provide further embodiments of the present invention without departing from the true spirit and scope of the invention.

In general, in the following claims, the terms used in the written description should not be construed to limit the claims to specific embodiments described herein for illustration, but should be construed to include all possible embodiments, both specific and generic, along with the full scope of equivalents to which such claims are entitled. Accordingly, the claims are not limited in haec verba by the disclosure.

I claim:

1. A highback with forward lean adjustor for a boot binding system with heel cup and baseplate, the heel cup defining a posterior top lip thereon, the highback comprising:

a) a highback body member having forward pivot ears configured to engage the heel cup and to pivot cooperatively thereon;

b) said highback body member defining an anterior surface configured to engage the ankle of a rider, a posterior surface with vertical centerline, said posterior surface having pivot ears contralaterally disposed across said centerline with a transverse pivot pin mounted horizontally therebetween;

c) an incompressible strut comprising a shaft member and an adjustor block, said strut having a first end and a second end, wherein said first end is mounted on said transverse pivot pin and is rotatable on said vertical centerline, said second end is defined by an end slot on said adjustor block, said end slot defining a seat configured to engage the posterior top lip of the heel cup in a standing position, and further wherein said adjustor block is mounted on said shaft member such that said incompressible strut is fixed in length when seated on the heel cup and adjustably lengthened or shortened when disengaged therefrom; and, d) further wherein said incompressible strut is characterized in that lengthening said strut results in a positive increment in lean angle when said strut is seated on the heel cup and shortening said strut results in a negative increment in lean angle when seated on the heel cup, said lean angle thereby ranging from a positive forward lean angle to a negative forward lean angle, wherein a zero lean angle is defined by essentially a zero angle between said backside spine of said highback body member and a line perpendicular to the baseplate.

2. The highback of claim 1, wherein said pivot ears define a pivot cradle with transverse pivot pin disposed therein; wherein said incompressible strut is configured to pivot with said transverse pivot pin between said standing position on top of said heel cup and an up-ended disengaged position such that said adjustor block is inverted above said pivot cradle.

3. The highback of claim 2, wherein said shaft member is a jackscrew affixed at an anterior end to said transverse pivot pin and pivotable therewith; and said adjustor block is threaded onto said jackscrew at a posterior end thereof and freely rotatable on said jackscrew such that turning said adjustor block clockwise or counterclockwise lengthens or shortens said strut.

4. The highback of claim 3, wherein said adjustor block includes a captive locking nut.

5. The highback of claim 3, wherein said adjustor block and jackscrew are configured to enable a forward lean mode and a recline mode.

6. The highback of claim 2, wherein said shaft member is a jackscrew affixed at said first end to said transverse pivot pin and pivotable therewith, and said adjustor block is threaded onto said jackscrew at said second end thereof such that said incompressible strut is adjustably lengthened or shortened by rotating said adjustor block on said jackscrew.

7. The highback of claim 1, wherein said boot binding system is configured for a splitboard or a snowboard.

8. The highback of claim 7, wherein said highback comprises a beam spanning from side to side of said highback body member at a top thereof, said beam defining an upper limit of an open slot through said highback body member below said beam, said slot having dimensions for inserting a hand; and, thereby providing a handle for grasping said highback body member.

9. A method for adjusting a highback over a range of positive and negative lean angles, which comprises:

(a) providing a splitboard boot binding system with baseplate for supporting a boot, toe and ankle straps, and heel cup, the heel cup having a posterior top lip;

(b) providing a highback body member having forward pivot ears configured to engage the heel cup and to pivot cooperatively thereon, said highback body member having a anterior surface configured to engage a rider's ankle, a posterior surface with vertical centerline and a pair of pivot ears contrallaterally disposed on said centerline, said pivot ears defining a transverse pivot cradle with transverse pivot pin disposed therein; an incompressible strut having a rigid shaft member and an adjustor block, said shaft member having a first end and a second end, wherein said first end is affixed to said transverse pivot pin in said pivot cradle and is rotatable on said vertical centerline between a standing, active engaged position and an inverted disengaged position;

said adjustor block is rotatably or slideably mounted on said second end of said rigid shaft member such that said adjustor block can be positioned to lengthen or shorten said strut, said adjustor block comprises an end slot disposed endwise thereon; wherein said end slot is configured to seat on the posterior top lip of the heel cup when said strut is pivoted to said standing, active engaged position; and, c) lengthening or shortening the length of said strut by adjusting the position of said adjustor block on said rigid shaft member so as to adjust the forward lean angle of the pivotable highback over a range of forward lean angles from positive to negative, wherein a zero lean angle is defined essentially by a zero angle between said posterior surface of said highback body member and a line perpendicular to the baseplate.

10. The method of claim 9, comprising a step for adjusting the length of said incompressible strut by slideably or rotatably positioning said adjustor block on said rigid shaft member.

11. The method of claim 9, comprising steps for:

(a) lifting said adjustor block off the posterior top lip of the heel cup so as to be fully disengaged and invertedly mounting it in a disengaged position;

(b) pivoting said adjustor block from said disengaged position to an intermediate position;

(c) adjusting said strut length to be longer or shorter; and, (d) pivoting said strut to said standing position by seating said end slot on the top posterior lip of the heel cup; and, (e) selecting a forward lean angle over a range of angles from positive to negative without using a tool.

12. The method of claim 11, comprising inverting said strut with attached forward lean adjustor block on said pivot axle so as to be fully disengaged from said heel cup.

13. The method of claim 9, wherein said shaft member of said incompressible strut is threaded at least in part, and said adjustor block is threadedly mounted on said threads of said shaft member, said method comprising rotatably adjusting said strut length by rotating said adjustor block on said shaft member in half turn increments.

14. The method of claim 13, wherein said threaded shaft member is a captive jackscrew, said adjustor block is threadably rotatable on said captive jackscrew, said jackscrew is affixed to said pivot axle, and comprising steps for threadably rotating said adjustor block on said jackscrew to extend or retract said strut length and then re-seating said adjustor block on the posterior top rim of the heel cup, thereby adjusting said forward lean angle in half turn increments.

15. The method of claim 9, further comprising a step for selecting a recline mode, wherein said recline mode is defined by a negative forward lean angle.

16. The method of claim 9, wherein said step for lengthening or shortening the length of said incompressible strut is achieved by sliding or moving said adjustor block up or down on said shaft member and locking said adjustor block in place thereon.

17. The method of claim 9, comprising providing a laterally disposed beam joining two sides of said highback body member above an open slot formed at a superior aspect thereof, thereby forming a handlebar, and further comprising a step for grasping said handlebar.

* * * * *